United States Patent [19]

Pinaire et al.

[11] 4,077,596

[45] Mar. 7, 1978

[54] LOW SILHOUETTE CHAIR TILTING CONTROL ASSEMBLY

[75] Inventors: Lon W. Pinaire, Evansville, Ind.; Robert H. Godwin, Evansville, Ind.

[73] Assignee: Bliss & Laughlin Industries, Incorporated, Oak Brook, Ill.

[21] Appl. No.: 588,063

[22] Filed: Jun. 18, 1975

[51] Int. Cl.[2] ..... A45D 19/04

[52] U.S. Cl. ..... 248/379; 248/382

[58] Field of Search ..... 248/372, 373, 379–382, 248/385, 387–392; 297/301–305, 325, 326; 267/149

[56] References Cited

U.S. PATENT DOCUMENTS

| | | | |
|---|---|---|---|
| 144,349 | 11/1873 | Morrison et al. | 297/303 |
| 176,654 | 4/1876 | Lunger | 248/378 |
| 198,655 | 12/1877 | Meeker | 248/382 |
| 354,183 | 12/1886 | Davis | 297/304 |
| 391,822 | 10/1888 | Stewart | 248/378 |
| 594,679 | 11/1897 | Davis | 297/304 |
| 2,360,428 | 10/1944 | Larsen et al. | 248/387 |
| 2,818,911 | 1/1958 | Syak | 297/303 X |
| 3,142,598 | 7/1964 | Rosen | 267/149 X |
| 3,203,661 | 8/1965 | Brendel | 248/379 X |
| 3,290,091 | 12/1966 | Goodman | 297/302 |
| 3,369,840 | 2/1968 | Dufton | 297/303 |
| 3,693,925 | 9/1972 | Weinstein | 248/378 |
| 3,740,792 | 6/1973 | Werner | 248/378 |
| 3,881,772 | 5/1975 | Mohrman | 297/304 X |

*Primary Examiner*—Lawrence J. Staab

*Attorney, Agent, or Firm*—Woodard, Weikart, Emhardt & Naughton

[57] ABSTRACT

A chair tilting control having a bracket connectable to a seat and a bracket connectable to a base, the base bracket being entirely within the seat connector bracket and having a pair of elongated flat spring bars urging the seat connector bracket against the base connector bracket to the no-tilt condition, and a manually operable spring adjustment screw or lever driving a cam follower to increase or decrease the non-tilting action of the spring.

23 Claims, 8 Drawing Figures

LOW SILHOUETTE CHAIR TILTING CONTROL ASSEMBLY

BACKGROUND OF THE INVENTION

1. Field of the Invention

This invention relates generally to chair controls, and more particularly to a vary compact chair control of neat appearance.

2. Description of the Prior Art

Many chair controls are known in the art. They involve a variety of sizes and shapes and mechanisms. A reference to any specific number of patents in this art could be misleading because of the possible omission of some other chair control which someone might consider relevant. One control of which we are aware and which was a step in the direction of attractive design and compact construction is shown in U.S. Pat. No. Des. 213,494.

Despite the many efforts toward simplified, more reliable, inexpensive, and attractive chair controls, further improvement was needed and the result is the present invention.

SUMMARY OF THE INVENTION

In a typical embodiment of the present invention, a chair control assembly has a base connector and a seat connector pivoted thereto on a horizontal axis. Between the base and seat connector there is at least one spring member which is adjustable by a manually operated member to increase or decrease the spring force urging the seat connector against the base connector in a non-tilting, stop direction. Different embodiments employ different adjusting means and the preferred spring is a flat bar-type elongated spring leaf member.

DESCRIPTION OF THE PREFERRED EMBODIMENT

Figure 1:
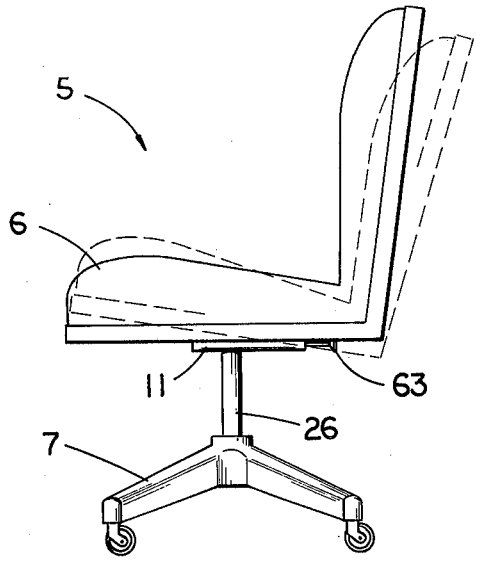
FIG. 1 is a side elevational view of a chair assembly using a chair tilting control assembly according to a typical embodiment of the present invention.
Figure 2:
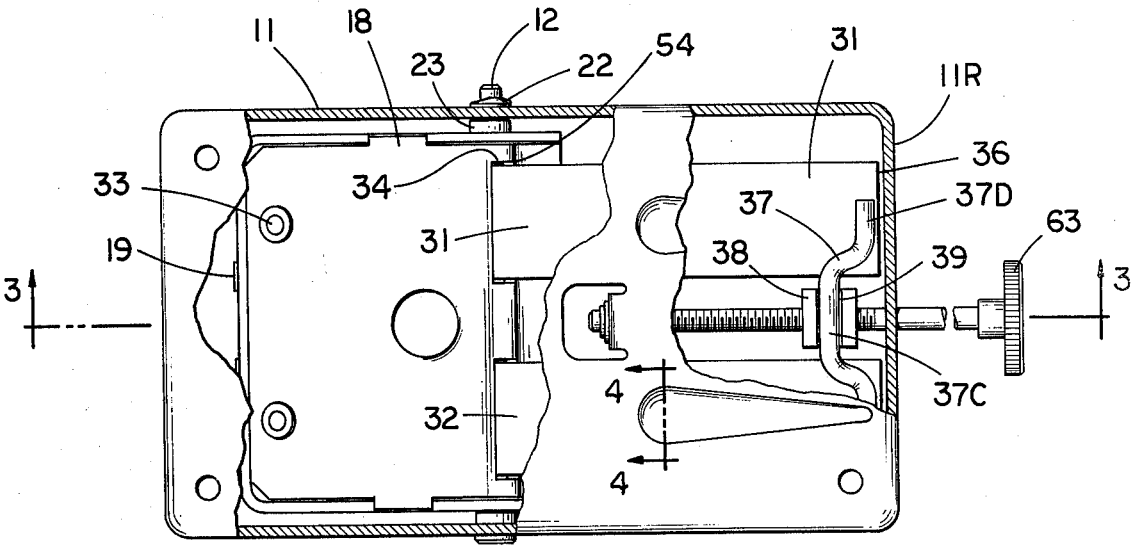
FIG. 2 is a fragmentary top plan view of the control assembly with portions broken away to show interior details.
Figure 4:
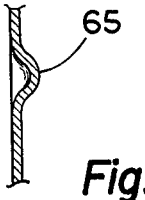
FIG. 4 is a section through a portion of the cam formed in the seat connector portion, the section being taken at the line 4—4 in FIG. 2 and viewed in the direction of the arrows.
Figure 5:
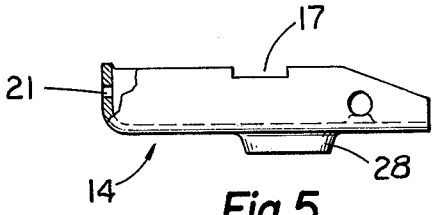
FIG. 5 is a side view of the spindle connector bracket itself.

Referring now to the drawings in detail, FIG. 1 shows a chair assembly 5 with seat 6, base 7 and spindle 26. The chair tilting control assembly 8 includes the seat connector bracket 11 (FIG. 2), horizontal pivot pin 12, and the base connector bracket assembly 13. The base connector bracket assembly includes a spindle connector bracket 14 and the spring mounting bracket 16 secured thereto. As is better shown in FIG. 5, the spindle connector bracket has a pair of notches 17 in the upper marginal edge, and the spring mounting bracket has a pair of lugs such as 18, one at each side, and which are received and located in these notches. Also, the spring mounting bracket has a plurality of tabs 19 therein which are received in slots 21 in the front upturned flange of the spindle connector bracket.

Pivot or hinge pin 12 is received in the upturned flanges at the sides of the spindle connector bracket, and is also received in the downwardly turned side flanges of the seat connector bracket and is retained in place by a push-on nut 22. Suitable spacers 23 can be provided between the downturned flanges of the seat connector bracket and the upturned flanges of the spindle connector bracket.

The assembly 13 is secured on the spindle 26 by forcing the assembly downwardly on the tapered surface 27 of the spindle, and downturned annular flange 28 of the spindle mounting bracket, and the downturned annular flange 29 of the spring mounting bracket, being thereupon snugly and securely affixed to the spindle.

In the illustrated embodiment, two spring bars 31 and 32 are employed. Each of these is mounted as bar 31 is mounted, by means of a pin 33 received through an aperture in the front end of the spring mounting bracket, the spring passing rearwardly therefrom through the aperture 34 in the spring mounting bracket, and toward the rear of the seat connector bracket, where the rear edge 36 of the spring bar is immediately in front of the rear downturned flange 11R of the seat connector bracket. A generally U-shaped rod 37 is received in a nut 38, the central portion 37C being received in the upwardly opening slot 39 in the nut, and the outboard portion 37D of the bar being received on top of the rear end of the spring bar.

The nut 38 is received on an adjustment screw 41 which is received through an aperture 42 in the rear downturned flange 11R of the seat connector portion, and a front downturned tab 43 is apertured to receive the front end mounting portion 44 of the screw therethrough, this being stepped down so that the front shoulder 46 of the screw rests against the tab 43, and a washer 48 retained by a snap ring 49 in the groove at the front of the screw, retains the screw longitudinally in the tab 43. The nut 38, being threadedly received on the screw, can be advanced toward the front of the control assembly in the direction of arrow 51, or retracted toward the rear of the assembly in the direction of the arrow 52.

The front end of the spring bar 31 abuts the underside of the spring mounting bracket at 53. The rear end of the spring bar abuts the outboard portion of the bar 37 which, in turn, abuts the underside of the seat connector bracket at 57. The midportion of the spring is supported on the spring mounting bracket at the bottom edge 54 of the aperture in the rear wall 56 thereof. Edge 54 is high enough to cause an upward bow in the center of an otherwise flat spring bar. Therefore the rear end of each spring urges the seat connector bracket in the direction of the arrow 58, so that the underside of the front portion thereof abuttingly engages the upper edge of the upturned flange 59 of the spindle connector bracket at 61, this being the non-tilt condition. Then, if the user of the seat mounted on top of the seat connector bracket leans back, the seat will tilt about pivot pin 12 in the direction of the arrow 62, thus increasing the spring return force as the tilting motion separates the underside of the front portion of the seat connector bracket from the upper edge 61 of the spindle connector bracket.

To increase the resistance of the assembly to tilting, the adjustment screw 41 is turned by means of the handle 63 thereon to drive the screw in rotation and thereby drive the nut 38 forward in the direction of arrow 51. As this occurs, the cam surface 65, which is formed in the top of the seat connector bracket, and which is inclined downwardly toward the front of the unit, urges the outboard portion 37D of the cam follower bar downward and away from the seat, thus increasing the spring bias in the spring bar as it is bowed to a greater degree about the fulcrum edge 54 in the spring mounting bracket. Accordingly, the resistance of the seat to tilting is increased. Turning the adjustment screw in the opposite direction achieves the opposite result.

The overall height of the unit is not affected as the adjustment is made, nor does the adjustment screw extend further out of or recede further into the unit. Thus, the very compact configuration remains the same, and the overall height of the unit itself can be kept at approximately one inch. Typically the spring bars are made of fiberglass, and the seat connector bracket, spring mounting bracket, and spindle connector bracket are made of formed sheet metal. The other components can also be made inexpensively of readily available, but reliable, materials.

Referring now to the alternate embodiment, the spring members are mounted in the same way as in the first described embodiment. However, a guide rod 66 is received through the aperture in the downturned tab 43 and passes through the aperture 42 in the rear wall 11R of the seat connector bracket, the rod having a head 67 thereon. A detent rail 68 has a front leg 69 and rear leg 71, both of which are apertured and received on the rod 66. The rod has a stop ring 72 received in a groove at the front end thereof whereby the rod is retained in assembly with the tab 43, rear wall 11R of the seat mounting bracket, and the two flanges 71 and 72 of the detent rail 68.

The lower edge of the detent rail has a series of downwardly projecting teeth 73 therein which receive the upwardly turned detent lug 74 of the adjustment handle 76 which is pivotally mounted at 77 to the seat connector bracket. The outer end of the lever 76 has a protective boot 78 thereon and can be pulled and pushed by the operator to pivot the lever 76 about the axis 77 and thus slide the cam follower mount block 38A along the rod 66. The block has a downwardly projecting pin 79 thereon received in the slot 81 of the operating lever, the pin and lever being retained together by a stop ring 82 received in a slot in the pin 79. The rings 82 and 72 may be of the Waldes-Kohinoor type, for example. The block 38A has a cam follower bar 37 mounted therein in the same manner as in the previously described embodiment, and thus functions in much the same way, except that it is operated by the lever rather than by a hand screw.

The spring 83 between the lever 76 and the stop ring 82, facilitates the movement of the lever detenting lug 74 along the downwardly facing teeth of the detent rail 68, but urges the lug up into the notches at all times so that any particular lever adjustment will be reliably maintained.

Figure 3:
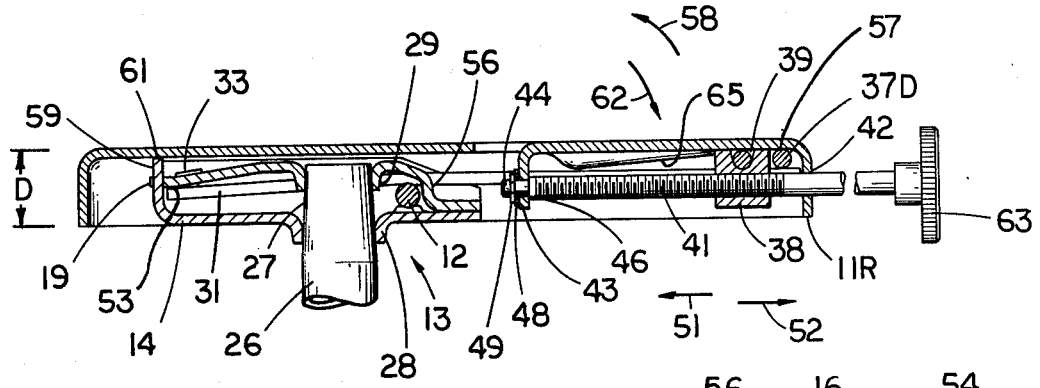
FIG. 3 is a section therethrough taken at line 3—3 in FIG. 2 and viewed in the direction of the arrows.
Figure 6:
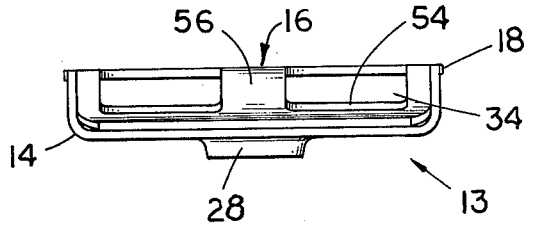
FIG. 6 is a front view of the assembly of the spindle connector bracket and spring mounting bracket.
Figure 8:
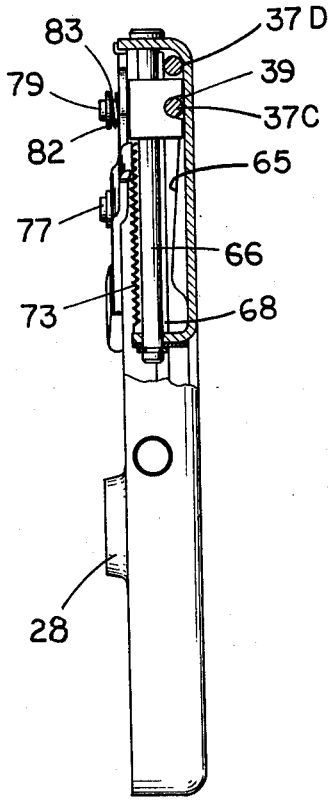
FIG. 8 is a side, partially sectioned, view of the alternate embodiment.
Figure 7:
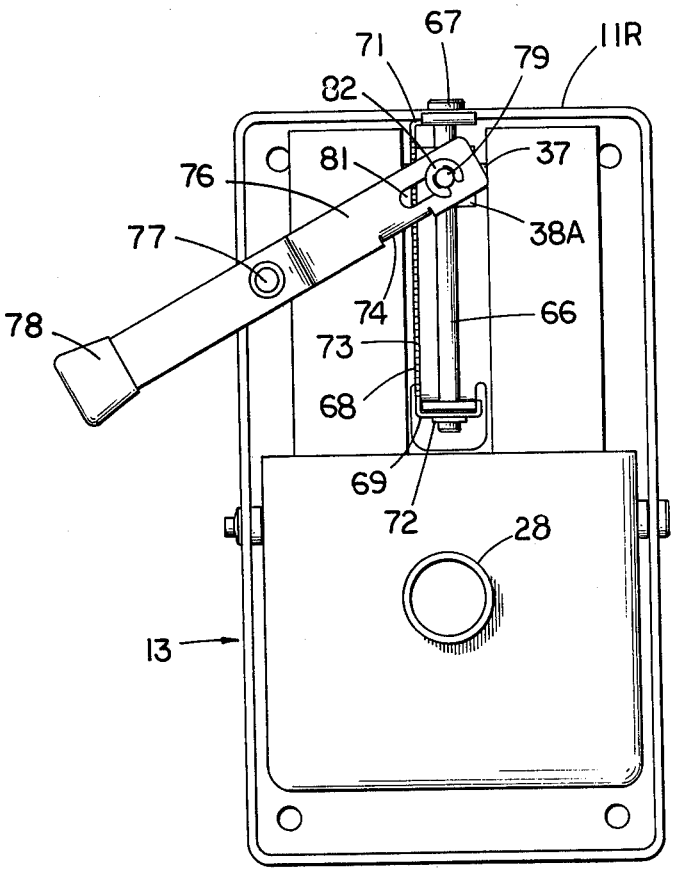
FIG. 7 is a bottom view of an alternate embodiment of the control assembly.

Because of the novel construction according to the invention, the overall height of the control assembly can be as little as one inch. The overall height is typically from 1.0 to 1.2 inches, "D" in FIG. 3.

What is claimed is:

1. In a chair control assembly having base connector means and seat connector means mounted to said base connector means for pivoting on a horizontal axis, the improvement comprising:

first and second horizontally spaced elongated spring members disposed between said base connector means and said seat connector means and applying force therebetween urging said seat connector means toward a stop condition with respect to said base connector means, said spring members being supported by fulcrum means between front and rear ends of said spring members, and linearly movable spring adjustment means mounted on one of said connector means and engaging the spring members and movable lengthwise of the spring members to change the resistance of said spring members to tilting of said seat connector means from said stop condition.

2. The improvement of claim 1 wherein:

said adjustment means include a manually operable drive screw mounted on one of said connector means parallel to said spring member, and nut means threaded on said screw, and a spring-loading member on said nut means and contacting said spring members and movable with said nut means relative to said fulcrum to establish such an amount of bow in said spring members when said seat connector means is in said stop condition as is needed to provide the desired amount of tilting resistance.

3. The improvement of claim 2 wherein:

said base connector means has a chair base spindle receiver therein.

4. The improvement of claim 1 wherein:

said spring adjustment means include a guide mounted on one of said connector means parallel to said spring members, and a slide received on said guide, and a hand lever pivotally mounted to one of said connector means to pivot in a horizontal plane about a vertical axis and connected to said slide to thereby move said slide on said guide, said slide bearing on said spring members at different locations as said slide is moved along said guide to change said force.

5. The improvement of claim 4 wherein:

said base connector means has a chair base spindle receiver therein.

6. The improvement of claim 1 wherein:

said second elongated spring member is in horizontally spaced parallel relation to said first spring member and engaged by said spring adjustment means for equal change of resistance of said spring members as said spring adjustment means is moved lengthwise of said spring members.

7. The improvement of claim 1 wherein:

said seat connector means includes an inverted shallow pan of formed sheet metal having a perimetrical downturned flange, said spring members being disposed entirely within the space encompassed by said flange when said seat connector means is in said stop condition.

8. The improvement of claim 1 and further comprising:

chair spindle receiver means in said base connector means and extending up between said spring members.

9. The improvement of claim 8 wherein:

said chair spindle receiver means has a generally vertical spindle axis proximate said horizontal axis but spaced therefrom to receive in said seat connector means a chair spindle on said spindle axis and a pivot pin on said horizontal axis without interference between the spindle and pin.

10. In a chair control assembly having base connector means and seat connector means mounted to said base connector means for pivoting on a horizontal axis, the improvement comprising:

an elongated spring member disposed between said base connector means and said seat connector means and applying force therebetween urging said seat connector means toward a stop condition with respect to said base connector means, and linearly movable spring adjustment means mounted on one of said connector means to change the resistance of said spring member to tilting of said seat connector means from said stop condition, said spring member being a spring leaf, said adjustment means including a manually operable drive screw mounted on one of said connector means parallel to said spring leaf, and nut means threaded on said screw, and spring contact means mounted on said nut means and movable therewith and contacting said spring leaf, and a guide on at least one of said connector means to place said contact means against said spring leaf at different locations and thereby change said force as said screw is turned and thereby said nut is moved to different locations, said screw and nut means being located beside and horizontally spaced from a portion of said spring leaf.

11. The improvement of claim 10 wherein the overall height of said seat connector means and base connector means in the stop condition is less than 1.2 inches.

12. The improvement of claim 10 and further comprising:

a second spring leaf in horizontally spaced parallel relationship to the first mentioned spring leaf, said spring contact means contacting both of said spring leaves, and said screw and nut means being located between portions of said spring leaves.

13. The improvement of claim 12 wherein said spring leaves are made of fibreglass.

14. In a chair control assembly having base connector means and seat connector means mounted to said base connector means for pivoting on a horizontal axis, the improvement comprising:

an elongated spring member disposed between said base connector means and said seat connector means and applying force therebetween urging said seat connector means toward a stop condition with respect to said base connector means, said spring member being supported by a fulcrum between front and rear ends of said spring member, and linearly movable spring adjustment means mounted on one of said connector means and engaging the spring member and movable lengthwise of the spring member to change the resistance of said spring member to tilting of said seat connector means from said stop condition, said spring member including a spring leaf; and said spring adjustment means being a guide mounted on one of said connector means parallel to said spring leaf, and a slide received on said guide, and a hand lever pivotally mounted to one of said connector means to pivot in a horizontal plane about a vertical axis and connected to said slide to thereby move said slide on said guide, said slide bearing on said spring member at different locations as said slide is moved along said guide, to change said force.

15. The improvement of claim 14 wherein:

at least a portion of said slide is beside a portion of said spring leaf.

16. The improvement of claim 15 and further comprising:

a second elongated spring member in horizontally spaced parallel relationship to the first mentioned spring member, said slide bearing on both of said spring members, and at least a portion of said slide being located between portions of said spring members.

17. The improvement of claim 16 wherein:

said second spring member includes a spring leaf, and said spring leaves are made of fibreglass.

18. The improvement of claim 14 wherein:

said leaf is bowed convex upwardly, and said horizontal pivot axis is between front and rear ends of said spring leaf and below the bowed center of said leaf.

19. The improvement of claim 18 and further comprising:

chair spindle receiver means in said base connector means adjacent said pivot axis and between said horizontally spaced spring leaves.

20. The improvement of claim 19 and further comprising:

a line of detents on one of said connector means, said line extending parallel to said guide, a detent portion in said lever and resiliently urged against the line of detents, to maintain a selected position of said lever, a manually graspable portion of said lever being outside said seat connector means and said base connector means.

21. The improvement of claim 20, and further comprising:

a seat connected to said seat connector means, and a base and spindle connected to said base connector means.

22. A chair control assembly comprising:

a first member connectable to a portion of a base;

a second member connected to a portion of a chair, said second member being pivotally mounted to said first member so that said second member is tiltable with respect to said first member about a horizontal pivot axis;

elongated leaf spring means confined by the first and second members and urging said first member vertically in one direction at a location in front of said axis and near the front of said leaf spring means and urging said second member vertically in said direction in a location behind said axis and near the rear end of said leaf spring means, thereby urging the second member with a force toward a tilt stop condition with respect to the first member, said spring means including a leaf having a fulcrum on one of said members generally centrally located between the ends of the spring leaf;

movable spring-adjustment means engaging said spring means and at least one of said members and movable horizontally towards said pivot axis and fulcrum to increase the urging force applied by said spring means;

said spring means comprising:

parallel spring leaves;

said first member having a spindle receiver therein; and said spring leaves being at opposite sides of said spindle receiver.

23. The assembly of claim 22 and further comprising:

a chair spindle projecting upwardly in said receiver and between said spring leaves.

* * * * *